US005307904A

United States Patent [19]

Yoo

[11] Patent Number: 5,307,904

[45] Date of Patent: May 3, 1994

[54] STOPPING OF ELEVATORS IN THE UP DIRECTION

[76] Inventor: Young S. Yoo, 76 Anvil Dr., Avon, Conn. 06001

[21] Appl. No.: 941,504

[22] Filed: Sep. 8, 1992

[51] Int. Cl.[5] ..... B66B 5/28

[52] U.S. Cl. ..... 187/67; 187/71; 187/75; 187/79

[58] Field of Search ..... 187/67, 71, 75, 77, 187/79, 95, 98, 108, 109

[56] References Cited

U.S. PATENT DOCUMENTS

| | | | |
|---|---|---|---|
| 249,076 | 11/1881 | Moulton | 187/67 |
| 673,301 | 4/1901 | Steinfeld et al. | 187/67 X |
| 688,601 | 12/1901 | Dean | 187/67 |
| 700,458 | 5/1902 | Trapp | 187/67 X |
| 1,929,672 | 10/1933 | Brannon | 187/67 |
| 1,932,060 | 10/1933 | Arnold | 187/67 |
| 3,674,117 | 7/1972 | Sjostrom et al. | 187/67 |

*Primary Examiner*—D. Glenn Dayoan

*Assistant Examiner*—Dean A. Reichard

[57] ABSTRACT

A stopped plate is provided in the overhead area in an elevator hoistway above the uppermost landing in the building. The stopping plate is mounted in the hoistway and is operable to stop upward movement of the elevator cab and counterweight without impacting the main components of the cab or counterweight. In one embodiment of the invention, there is provided a pair of inverted safeties mounted on the stopping plate and guide rails. If the cab rises above the uppermost landing, the safeties will be set by the cab contacting the stopping plate, thereby limiting further upward motion of the cab. In a second embodiment of the invention, the traction cables are provided with motion arresters such as enlarged clamps, which are secured to the cables a preset distance above the cab assembly. The cables pass through restricted openings in the stopping plate, which openings will not allow passage of the motion arresters. Motion of the traction cables is thus arrested when the cable clamps encounter the stopping plate.

9 Claims, 2 Drawing Sheets

STOPPING OF ELEVATORS IN THE UP DIRECTION

TECHNICAL FIELD

This invention relates to the problem of arresting undesirable movement of an elevator cab or counterweight in the upward direction. More particularly, this invention relates to the arresting of upward movement which occurs above the uppermost landing in the building.

BACKGROUND ART

Elevators are presently provided with a plurality of braking devices which are designed for use in normal operation of the elevator, as for example to hold the cab in place when it stops at a landing and which are designed for use in emergency situations such as stopping the cab and/or counterweight from plunging into the hoistway pit.

Elevator safeties are typically devices mounted on the car frame or counterweight assembly which are tripped by sensed overspeed of a governor cable connected to the cab or counterweight. Once the safeties are tripped, they will typically grab the guide rails in the hoistway to stop the cab or counterweight. The elevator safeties described above are not operated in an instance where the cab is moving out of control in the upward direction in the hoistway.

Concerns as to passenger safety in an elevator cab moving out of control in the upward direction in a hoistway have prompted safety code revisions in North America which mandate that elevator systems include provisions for safely stopping a runaway cab in the upward direction. These revisions have prompted research and investigation into braking systems which can provide the required function. U.S. Pat. No. 4,977,982, granted Dec. 18, 1990 to L. Bialy, et al., discloses an elevator sheave brake safety which acts directly on the drive sheave to jam the latter in the case of uncontrolled upward movement of the elevator cab, whereby the cab is stopped in the hoistway. The brake safety can also stop movement of the cab away from a landing in the event that the cab doors are open. Both of these features are desirable safety features The brake safety disclosed in this patent utilizes a pair of wedge blocks which flank the sheave and are spring-biased toward the sheave. When the safety is tripped by undesirable cab movement, the wedges will move against and jam the sheave so that it stops rotating, thereby stopping the cab. The wedging can stop the cab in both the up and down directions. U.S. Pat. No. 5,007,505, granted Apr. 16, 1991 to R. Lindegger, discloses an elevator traction sheave brake which includes a vertically reciprocating spring-biased friction plate beneath the sheave. The friction plate is normally held away from the sheave, but during undesirable cab movement, it will move upwardly to jam rotational movement of the sheave. As before, this brake can stop upward or downward movement of the cab.

Both of the aforesaid brake assemblies operate directly on the drive sheave or a part attached thereto to jam the sheave at its circumference and can thus damage the sheave or create a wedged engagement with the sheave that is very difficult to release. Each of these brakes also results in minimal surface contact between the sheave and the brakes whereby forces exerted on the sheave are quite concentrated and whereby the cab will be jolted to a stop when the brakes trip.

There are several problems relating to the prior art elevator up direction safeties which remain to be solved. One problem relates to the development of a brake which can be easily retrofitted onto an existing elevator system in the field The ability of the brake to be readily released, to be reused without refurbishing, and to operate with a relatively low power supply are also highly desirable.

DISCLOSURE OF THE INVENTION

This invention relates to an elevator up direction braking system which will arrest undesirable upward movement of an elevator or counterweight, which movement occurs above the uppermost landing in the building. In a first embodiment, the invention utilizes a stopping plate or beam which is mounted on the guide rails on the side walls of the elevator hoistway and which extends across the hoistway above the cab or counterweight. The stopping plate is downwardly offset from the machine room floor and is preferably about three feet above the top of the crosshead when car is parked on the top landing. Buffer springs are preferably mounted on the stopping plate and extend downwardly therefrom toward the top of the cab or counterweight. The ends of the stopping plate carry inverted safety assemblies which connect the stopping plate to the guide rails. If the cab travels upwardly 12 inches beyond the uppermost landing, normally the final limit switch will be activated, thus cutting off the power to the machine and applying the brake. If this fails to happen and the car continues to travel in the upward direction out of control, the car will be initially retarded by the stopper plate buffers. Once buffer movement is exhausted, the cab will tend to push the stopper plate upwardly toward the hoistway roof or overhead, whereupon the stopper plate safeties will tighten on the guide rails. The safeties thus serve to control and limit movement of the stopper plate and cab assembly so as to decelerate and stop the cab at a distance of preferably not less than 6 feet after initial contact for a car traveling at 1,200 feet/min. and 18 feet for a car speed of 2,000 feet/min. Another way to retard undesirable upward movement of the roped components is to secure motion arresters to the cables above each of the rigid components and pass the cables through restricted passages in the stopper plates. Abnormal upward movement of either roped component will bring the motion arresters into engagement with the passage side walls which will retard further upward motion of the cables and thereby substantially halt the upward movement of the cab assembly or counterweight depending on which is moving in the upward direction.

It is therefore an object of this invention to provide an up direction elevator motion arrester.

It is a further object of this invention to provide a motion arrester of the character described which will retard and decelerate undesirable upward movement of a roped elevator component which occurs above the uppermost landing in the building.

It is an additional object of the invention to provide a motion arrester of the character described which can be retrofitted onto older elevator equipment in the field.

These and other objects and advantages of the invention will become more readily apparent from the following detailed description of several embodiments of the invention when taken in conjunction with the accompanying drawings in which:

BEST MODE FOR CARRYING OUT THE INVENTION

Figure 1:
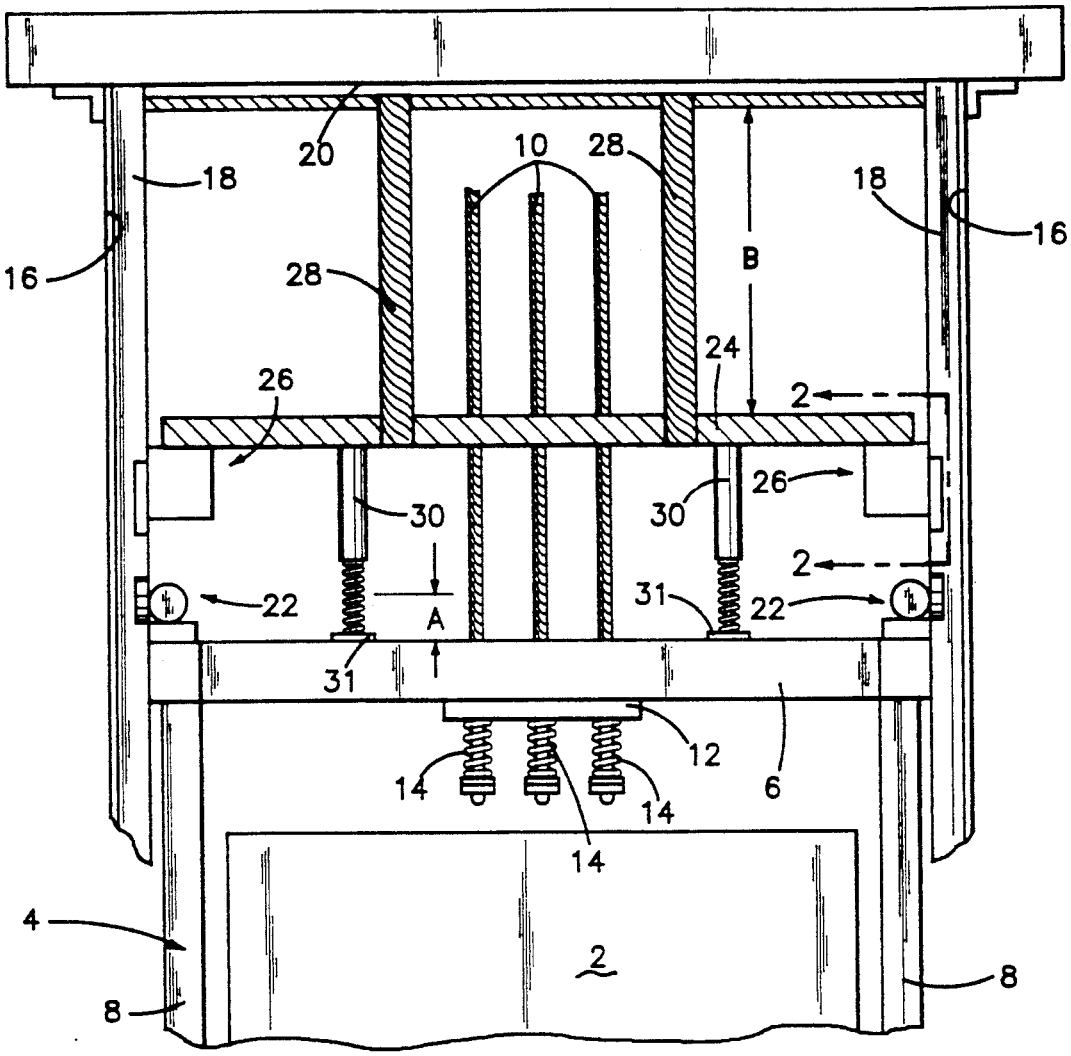
FIG. 1 is a fragmented schematic view of a first embodiment of an up direction elevator motion arrester formed in accordance with this invention.

Referring to the drawings, FIG. 1 shows in schematic fashion an elevator system which includes a cab 2 mounted in a frame 4 having a top crosshead 6 and vertical stiles 8 secured to the crosshead 6. The frame 4 is suspended from traction cables 10 which are connected to a hitch plate 12 on the crosshead 6 via coil springs 14. The frame 4 and cab 2 move up and down on the elevator hoistway 16 on guide rails 18 which extend from the hoistway overhead 20 to the floor of the hoistway pit (not shown). Guide roller assemblies 22 may be mounted on the tops of the frame 4 to guide movement of the cab assembly over the guide rails 18.

The traction cables 10 pass through a stopping plate or beam 24 which is interposed between the frame crosshead 6 and the hoistway overhead 20. The plate 24 is mounted on the guide rails 18 via a pair of inverted safety assemblies 26 which are operable to set and lock against the guide rails 18 when the plate 24 is moved upwardly toward the overhead 20. Positive stops 28 will prevent the plate 24 from falling down in case the partial engagement of safety wedges is not sufficient to hold the stopping plate 24 on the rails 18. These stops are simply two flexible, high-strength ropes or tapes wrapped around the building structure and the plate 24. A pair of spring buffers 30 is mounted on the underside of the plate 24 and extend toward the crosshead 6.

Figure 2:
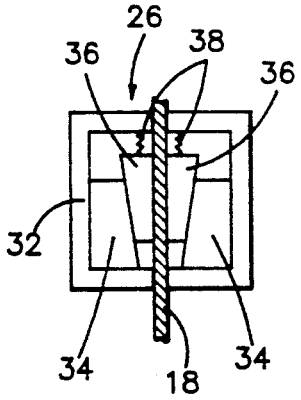
FIG. 2 is a sectional view taken along line 2—2 of FIG. 1.

Referring to FIG. 2, details of the safety assemblies 26 are shown. Each assembly 26 includes an outer housing 32 in which are disposed pairs of wedging elements 34 and 36. The innermost wedging elements 36 engage the guide rails 18, and the outermost elements 34 engage the housing 32. When the assembly 26 is moved upwardly on the rails 18, the outer wedges 34 will force the inner wedges 36 against the rail 18 to lock the assembly 26 onto the rail 18. Springs 38 ma be included to bias the inner wedges 36 downwardly against the outer wedges 34.

The system operates as follows. If the cab 2 and frame 4 move upwardly in the hoistway 16 above the uppermost landing beyond the final limit switch, the strike plates 31 on crosshead 6 will first contact the spring buffers 30 for a distance A whereby the cab assembly will begin to decelerate and the springs will be compressed solid. Further upward movement will increase the force between the crosshead 6 and the plate 24, whereafter the plate 24 will begin to be pushed upward toward the overhead 20. Upward movement of the plate 24 causes the safety assemblies 26 to tighten and set on the rails 18 whereby both the plate 24 and cab assembly 2 will be decelerated and stopped before reaching the overhead 20, the stopping distance being less than the distance B. Manual resetting of this up direction stopping device is accomplished by lowering the car and pulling the plate 24. As the wedges are released, they will fall down into place by gravity. The plate 24 can be pulled down manually or by an automatic pull down mechanism which can be designed using solenoids or a spring-biased mechanism with appropriate linkages.

Figure 3:
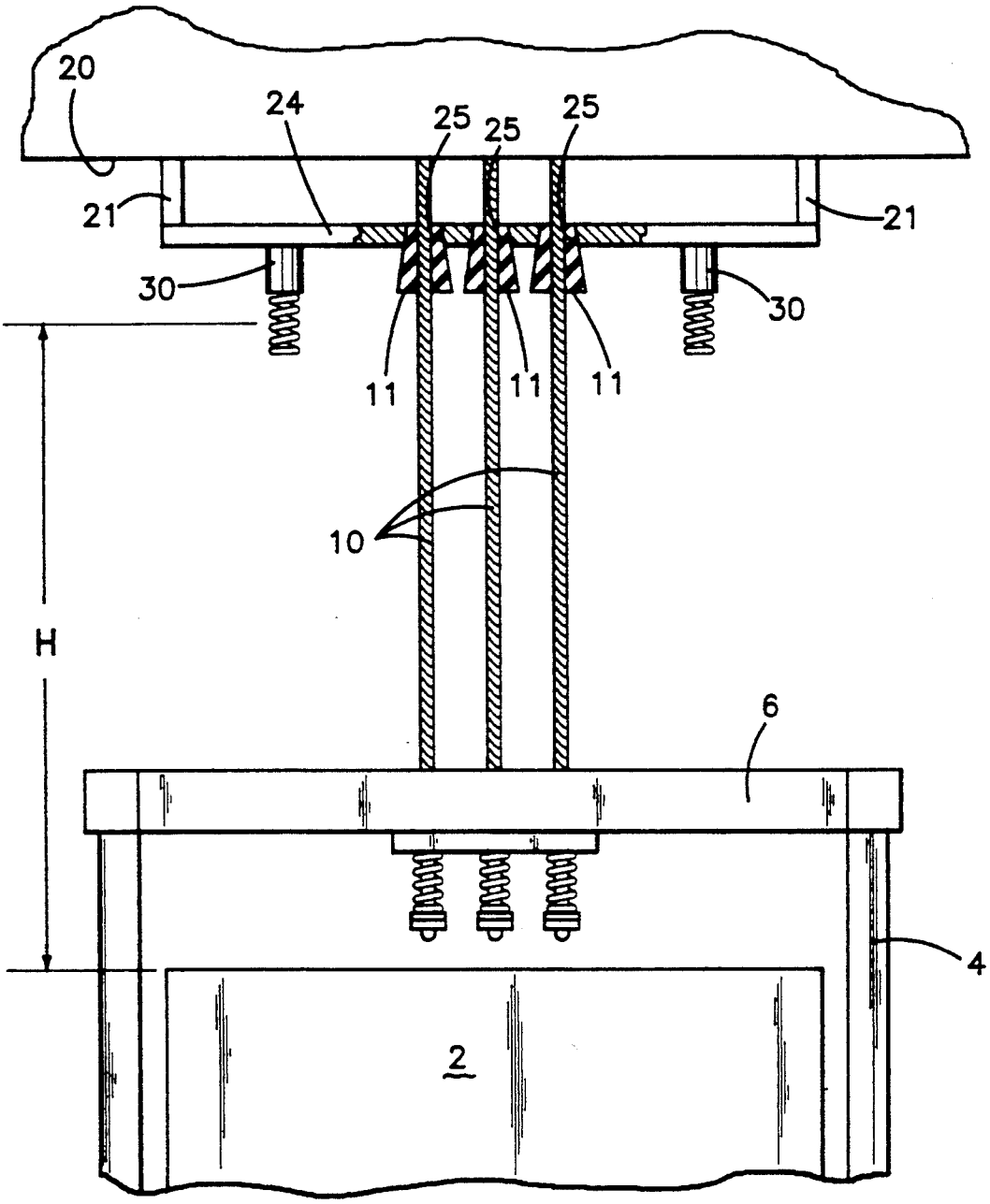
FIG. 3 is a fragmented schematic view of a second embodiment of an up direction elevator motion arrester formed in accordance with the invention.

Referring to FIG. 3, there is disclosed a second embodiment of a deceleration system using a stopping plate disposed in the hoistway below the overhead. The reference numerals for the second embodiment are the same for common components shown in the first embodiment. The cab 2 is mounted in frame 4 which has a crosshead beam 6 to which the traction cables 10 are hitched. The stopping plate 24 is mounted on the overhead 20 by means of supports 21 which space the plate 24 from the overhead 20. The traction cables 10 pass through restricted tapered openings 25 to the plate 24. Each of the traction cables 10 has an enlarged tapered clamp 11 fixed thereto. If the cab 2 rises above the uppermost landing a predetermined distance, the clamps 11 will be brought into engagement with the plate 24. As the clamps 11 are engaged in, the plate 24 holes, they will be tighter but will still allow sliding. The sliding distances will be determined by the wedge angle, and the buffers will be used as an additional retarding mechanism. The total distance required for the car stoppage is H, and this should be approximately the same as the sum of A and B in FIG. 1. The wedges can be reset normally after landing the car or by an appropriate automatic pull down mechanism using solenoids or a spring-biased mechanism with suitable linkage.

Since many changes and variations of the disclosed embodiments of this invention may be made without departing from the inventive concept, it is not intended to limit the invention otherwise than as required by the appended claims.

What is claimed is:

1. An elevator cab motion arrester assembly for stopping upward motion of an elevator cab assembly which occurs above the uppermost landing in an elevator hoistway, said arrester assembly comprising:

a) a stopping plate mounted in the hoistway above the uppermost landing thereof;

b) means for fixing said stopping plate against downward movement in said hoistway;

c) spring means mounted on said stopping plate and depending downwardly therefrom toward the elevator cab assembly, said spring means being operable to retard upward movement of the cab assembly above said uppermost landing; and d) proportionally tightening frictionally operated wedging means operably connected to said stopping plate, said frictionally operated means being operable in conjunction with said spring means to stop upward movement of said cab assembly.

2. The motion arrester assembly of claim 1 wherein said frictionally operated means comprises inverted safety assemblies mounted on said stopping plate, said safety assemblies engaging elevator cab assembly guide rails in the hoistway, and said safety assemblies further being operable to retard both upward and downward movement of said stopping plate in the hoistway.

3. The motion arrester assembly of claim 1 wherein said means for fixing comprises a plurality of cables connecting said stopping plate to the upper end of the hoistway, said cables being operable to retard downward movement of said stopping plate in the hoistway.

4. The motion arrester assembly of claim 1 wherein said frictionally operated means comprises a plurality of restricted openings in said stopping plate, hoist ropes on the cab assembly passing through said stopping plate openings; and enlarged clamp means mounted on the hoist ropes, said clamp means being positioned on the hoist ropes for engagement with the stopping plate when the cab assembly rises above the uppermost hoistway landing.

5. An elevator cab motion arrester assembly for stopping upward motion of an elevator cab assembly which occurs above the uppermost landing in an elevator hoistway, said arrester assembly comprising:

a) a stopping plate mounted in the hoistway above the uppermost landing thereof; and b) inverted safety assemblies mounted on said stopping plate, said safety assemblies engaging guide rails fixed in the hoistway, and said safety assemblies being operable to retard upward movement of said stopping plate when the latter encounters said cab assembly.

6. The motion arrester assembly of claim 5 further comprising spring means mounted on said stopping plate and depending downwardly from the latter toward said cab assembly, said spring means being operable to provide motion retarding contact with said cab assembly prior to initiation of upward movement of said stopping plate.

7. The motion arrester assembly of claim 6 further comprising a plurality of cables connected to said stopping plate and operable to retard downward movement of said stopping plate.

8. An elevator cab motion arrester assembly for stopping upward motion of an elevator cab assembly which occurs above the uppermost landing in an elevator hoistway, said arrester assembly comprising:

a) a stopping plate mounted in the hoistway above the uppermost landing thereof said stopping plate including a plurality of restricted passages therethrough, said passages containing hoist ropes connected to the cab assembly whereby the hoist ropes move upwardly and downwardly through the stopping plate; and b) enlarged clamp means mounted on the hoist ropes, said clamp means being positioned on the hoist ropes for engagement with the stopping plate when the cab assembly rises above the uppermost hoistway landing.

9. The motion arrester assembly of claim 8 further comprising spring means mounted on said stopping plate and depending downwardly therefrom toward said cab assembly, said spring means being operable to provide motion retarding contact with said cab assembly subsequent to engagement of said clamp means with said stopping plate.

* * * * *